US011019892B2

(12) United States Patent
Cantoni

(10) Patent No.: US 11,019,892 B2
(45) Date of Patent: Jun. 1, 2021

(54) METHOD FOR MANUFACTURING AN ORNAMENT MADE OF PRECIOUS METAL AND ORNAMENT MANUFACTURED THEREBY

(71) Applicant: Giovanna Cantoni, Turin (IT)

(72) Inventor: Giovanna Cantoni, Turin (IT)

( * ) Notice: Subject to any disclaimer, the term of this patent is extended or adjusted under 35 U.S.C. 154(b) by 473 days.

(21) Appl. No.: 15/305,370

(22) PCT Filed: Mar. 27, 2015

(86) PCT No.: PCT/IB2015/052278

§ 371 (c)(1),
(2) Date: Oct. 20, 2016

(87) PCT Pub. No.: WO2015/162510

PCT Pub. Date: Oct. 29, 2015

(65) Prior Publication Data

US 2017/0035163 A1 Feb. 9, 2017

(30) Foreign Application Priority Data

Apr. 24, 2014 (IT) ..... TO2014A000344

(51) Int. Cl.

| | |
|---|---|
| ***A44C 27/00*** | (2006.01) |
| ***A44C 17/04*** | (2006.01) |
| ***B21D 53/44*** | (2006.01) |

(52) U.S. Cl.

CPC ..... *A44C 27/002* (2013.01); *A44C 17/04* (2013.01); *A44C 27/00* (2013.01); *B21D 53/44* (2013.01)

(58) Field of Classification Search

CPC ..... B21D 53/44; Y10T 29/49597; Y10T 29/49588–49593; Y10T 29/30–301;
(Continued)

(56) References Cited

FOREIGN PATENT DOCUMENTS

| | | | |
|---|---|---|---|
| CN | 101313793 | A | 12/2008 |
| CN | 101767273 | A | 7/2010 |
| CN | 102990305 | A | 3/2013 |

OTHER PUBLICATIONS

Crowe, Ben; basic inlay technique part 1—marking out and cutting out a new guitar inlay; published Sep. 16, 2012; Crimson Custom Guitars; https://www.youtube.com/watch?v=KW9tiZOpupU; Screen captures obtained Dec. 5, 2018.*

(Continued)

*Primary Examiner* — Matthew P Travers
(74) *Attorney, Agent, or Firm* — Howson & Howson LLP

(57) ABSTRACT

A method for manufacturing ornaments made of precious metals is provided. A sheet, plate or foil made of pure precious metal—i.e. having a fineness equal to or greater than 999 parts per thousand—is provided, a profile of a desired shape is traced, and the sheet or plate is cut according to the profile to obtain an ornament having the desired shape. The method obtains ornaments made of precious metal of any two-dimensional shape in a short time with limited manufacturing costs. The method can be used to produce a large number of variants of commercial collections of jewels and/or ornaments made of pure precious metals according to the commercial choices of the manufacturer, and to obtain "tailor-made" ornaments made of pure precious metal—i.e. starting from a specific design of the user—in a very short time, or even immediately.

10 Claims, 3 Drawing Sheets

(58) Field of Classification Search
CPC .... B44C 1/26; B44C 1/10; B44C 1/14; B44C 1/18; B44C 1/225; B44C 1/28; A44C 27/00–27/002
See application file for complete search history.

(56) References Cited

OTHER PUBLICATIONS

Crowe, Ben; basic inlay technique part 2—recessing the cavity and gluing in the new guitar inlay; published Sep. 24, 2012; Crimson Custom Guitars; https://www.youtube.com/watch?annotation_id=annotation_516436&feature=iv&src_vid=KW9tiZOppU&v=ACHki_NIsTM Screen captures obtained Dec. 5, 2018.*
How to make gold wire and sheet for inlay; Available online Sep. 5, 2013; Engraving School; http://www.engravingschool.com/private/gold-wire.htm.*
H. Blankenship, "Get the Knowledge with Hiedi Blankenship—Edgeabilities and Foil, a Holiday Ensemble", URL: http://www.spellbinderspaperarts.com/Community/Blog/Post/11-10-27/Get_The_Knowledge_with_Heidi_Blankenship.aspx, Oct. 2011.

* cited by examiner

METHOD FOR MANUFACTURING AN ORNAMENT MADE OF PRECIOUS METAL AND ORNAMENT MANUFACTURED THEREBY

TECHNICAL FIELD

The present invention relates to a method for manufacturing an ornament made of precious metals, as well as an ornament manufactured thereby.

In particular, the present invention relates to a method for manufacturing an ornament made of silver, gold or platinum, as well as an ornament manufactured thereby.

More particularly, the present invention relates to a method for manufacturing an ornament made of pure silver, gold or platinum—i.e. with a fineness equal to or greater than 999 parts per thousand—as well as an ornament manufactured thereby.

PRIOR ART

In the field of goldsmithing pure precious metals—namely silver, gold and platinum are provided in the form of sheets, plates or foils.

Disadvantageously, pure precious metals are excessively ductile and malleable and therefore it is extremely difficult to manufacture jewelry according to the desired shape and—above all—to guarantee that the jewels maintain the given shape when they are worn, without bending or deforming.

According to prior art, this drawback is overcome by melting the sheets, plates or foils of pure metal and mixing them with other metals to obtain alloys which can be more easily manufactured and provide finished products with a higher hardness.

Reference is therefore made to the "fineness", expressed in parts per thousand, for indicating the amount of precious metal in the alloy of a jewelry item in thousands per gram.

By way of example, the gold employed in goldsmithing is usually used in alloys with a fineness in gold of 750 parts per thousand. Specifically, the so-called "yellow gold" is actually an alloy composed of 750 parts per thousand of gold, 70-120 parts per thousand of silver and 130-180 parts per thousand of copper, the so-called "white gold" is actually an alloy composed of 750 parts per thousand of gold and 250 parts per thousand of silver, nickel or palladium, the so-called "red gold" is actually an alloy composed of 750 parts per thousands of gold, 45 parts per thousand of silver and 205 parts per thousand of copper, and so on.

While the currently known processes allow to overcome the drawbacks connected to excessive ductility and malleability of precious metals, the need of obtaining beforehand metal alloys for manufacturing items and ornaments made of precious metal poses a number of limitations.

Firstly, it is necessary to carry out a step of melting the selected pure precious metal with one or more different metals in order to obtain a workable alloy.

In addition, users will find only a limited set of possible shapes for items, jewels and ornaments available on the market, such shapes corresponding to the ones chosen by goldsmiths and jewelers for their collections.

Even the possible alternative of making "tailor-made" jewels and ornaments, i.e. starting from a specific design required by an individual user, is not free from drawbacks.

Firstly, due the complexity of the manufacturing process, the production of "tailor-made" jewels and ornaments involves a remarkable increase in the costs for the same amount of precious metal content in the jewel or ornament.

Secondly, still due to the complexity of the manufacturing process, a jewel or ornament manufactured starting from a specific design provided by the user is not immediately available, but on the contrary involves considerable waiting times.

Furthermore, in any case these items, jewels and ornaments are manufactured by using not a pure precious metal, but always an alloy that, besides the precious metal, also contains one or more non-precious metals.

An object of the present invention is therefore to overcome the drawbacks of prior art by providing a method for manufacturing ornaments made of precious metals that allows the widest possible degree of freedom in the shapes available to the user.

More particularly, an object of the present invention is to provide a method for manufacturing ornaments made of pure precious metals that on one hand allows a goldsmith to make a large number of variants of commercial collections of jewels and ornaments, and on the other hand allows a single user to get an ornament with any desired shape.

An object of the present invention is also to provide a method for manufacturing ornaments made of precious metals that allows to make "tailor-made" ornaments in extremely short times.

An object of the present invention is also to allow the end user to witness the production of the ornament, imparting directions concerning the shape and successive processing of the ornament itself.

An object of the present invention is also to provide a method for manufacturing ornaments made of precious metals at a low cost.

An object of the present invention is also to provide the possibility of manufacturing ornaments by exclusively using a pure precious metal.

These and other objects are achieved by the method claimed in the appended claims.

SUMMARY OF THE INVENTION

The method according to the invention provides for obtaining ornaments made of precious metals directly from sheets, plates or foils of pure precious metals, without making any alloys with other metals.

It should be noted that herein:

"ornament" means any decorative element; the term "ornament" as used herein includes—by way of non-limiting example—jewels (such as pendants, charms, brooches or inserts), applications for leather goods (such as handbags, wallets, belts and shoes), accessories in general (such as glasses or key-rings), applications for clothes, plates, knick-knacks and so on;

"pure precious metal" means a precious metal with a fineness equal to or greater than 999 parts per thousand;

"sheet" means in general any support having a thickness much smaller than its surface area (including sheets, plates, foils and the like).

According to the invention, the ornament is directly cut out from the sheet, plate or foil of pure precious metal according to the desired shape.

Unlike the prior art, wherein the problem posed by the excessive ductility and malleability of the precious metals is solved by making alloys with non-precious metals, the present invention uses a different approach, which has not been adopted so far.

This approach provides for manufacturing the ornament from a sheet, plate or foil of pure precious metal.

The use of pure precious metals alone, instead of using them in alloy with other metals, poses significant technical problems concerning both the possibility of obtaining an ornament of desired shape capable of maintaining such shape over time without deformation, and the possibility of maintaining a satisfactory aesthetic appearance over time without deterioration of its surface characteristics. For this reason, such a solution would not be 30 obvious for a person skilled in the art of goldsmithing.

In order to obtain an ornament which is capable of maintaining its shape without deforming, the invention provides to manufacture the ornament from a sheet, plate or foil of pure precious metal that has a suitably selected thickness. On the one hand, said thickness shall be high enough to prevent the obtained ornament from being excessively ductile and malleable and therefore subjected to the risk of bending, while on the other hand it shall be sufficiently low to allow cutting according to the desired shape and comfortable wearing.

In the case of manufacturers of jewels or other ornaments, the desired shape or shapes to be cut out from the sheet or plate or foil can meet the need of creating different commercial collections characterized by specific shapes, selected and implemented on a large scale.

In the case of individual users, the desired shape—still to be cut out from said sheet or plate or foil—can meet the desire of having a "tailor-made" jewel or ornament, having a peculiar shape that might be even unavailable on the market.

Thanks to this solution, any two-dimensional shape can be easily obtained in a short time and at extremely low manufacturing costs.

More particularly, in case of manufacturing of "tailor-made" ornaments, upon specific request of a single user, such ornaments can be manufactured in an extremely short, even immediate, time, according to the instructions of the user during the cutting itself.

Even in case of large-scale productions by manufacturers of jewels or other ornaments, the manufacturing time for obtaining jewels and ornaments according to the method of the invention will be drastically reduced with respect to those for the manufacturing of jewels by using traditional methods.

In addition, the manufacturer will also benefit of the advantage of being able to choose to implement any shape for creating commercial collections of jewels and/or ornaments of pure precious metal by simply cutting out the desired shape from the sheet, plate or foil of desired pure precious metal.

Advantageously, the ornaments obtained by the method according to the invention will be made of a pure precious metal, which will provide the user both with an extremely strong guarantee about the value of the purchased ornament value, and with the originality of owning an ornament cut out from a sheet, plate or foil of pure precious metal, without making any alloys with other metals.

The method according to the invention may provide—after the cutting step—one or more successive finishing steps, according to the techniques commonly within the reach of the person skilled in the art.

These finishing steps may include, by way of non-limiting example, surface treatments, engravings, setting of precious and/or semi-precious stones and/or pearls, engravings of photographs (so-called "picture jewelry"), applying enamel, and so on.

The method according to the invention will preferably provide for a step of surface finishing, namely of glazing. This glazing step is provided for taking into account the fact that pure precious metals—due to their high ductility and malleability—are particularly subject to scratching and abrasion, and to a consequent deterioration of their aesthetic appearance: by providing a glazing step it is possible to guarantee the maintenance of a satisfactory aesthetic appearance over time.

It should be noted that, in general, as the method according to the invention only provides for a simple cutting step—possibly followed by a step of surface finishing—it is possible to keep the manufacturing costs low, despite the high value of the raw materials that are used.

The ornament thus obtained can be used either alone for instance as a pendant, brooch, key-ring, knick-knack, and the like or applied to a carrier of any material, depending on its final destination and on the desires of the user or on the commercial choices of the manufacturer.

By way of non-limiting example, the obtained ornament may be used as a complement of jewels such as bracelets, necklaces, earrings, rings and the like, it may be applied to leather products, it may be applied to cloths, fabrics or other materials in general, and so on.

BRIEF DESCRIPTION OF THE DRAWINGS

Further characteristics and advantages of the present invention will become evident from the following description of some preferred embodiments of the invention, given by way of non-limiting example with reference to the accompanying drawings, in which.

DESCRIPTION OF SOME PREFERRED EMBODIMENTS OF THE INVENTION

Figure 1A:
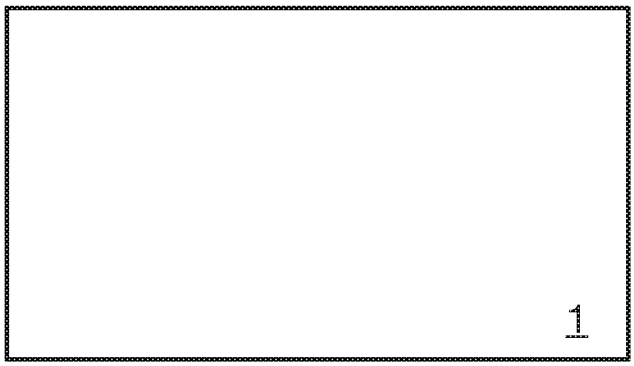
FIGS. 1*a*-1*c* schematically show the main steps of the method according to the invention.
Figure 1B:
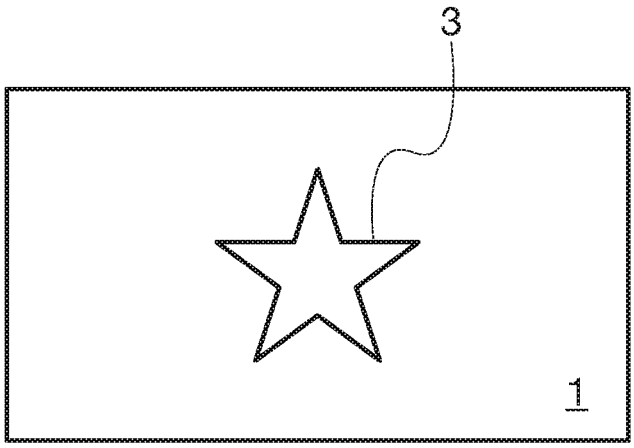
Figure 1C:
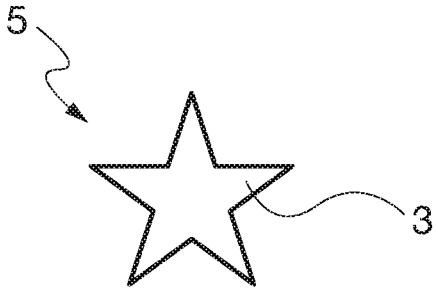

With reference initially to FIGS. 1*a*-1*c*, the method according to the invention comprises at least the steps of:

- providing a sheet, plate or foil 1 made of pure precious metal (FIG. 1*a*);
- tracing the profile 3 of a desired shape;
- cutting said sheet, plate or foil 1 according to said profile 3 for obtaining the ornament 5 having the desired shape.

The sheet, plate or foil 1 is obtained in a per se known manner by:

- melting the precious metal in the crucible and successively casting in a mold;
- rolling the metal thus obtained in a rolling machine; thanks to rolling, the metal becomes "green" and therefore harder and less ductile and malleable;
- eliminating irregularities present in the sheet, plate or foil, by means of a new passage through the rolling machine, but in a reverse direction and by processing with cross-strokes.

In a non-limiting example, the precious metals that can be used in the method according to the invention include silver, gold and platinum.

As mentioned above, according to the invention the sheet or plate 1 will be made of a precious metal with a fineness equal to or greater than 999 parts per thousand.

As mentioned above, according to the invention the thickness of said sheet or plate is selected so as to obtain an ornament having a sufficient rigidity despite the high ductility and malleability of precious metals having a fineness equal to or greater than 999 parts per thousand and, at the same time, to make sure of being able to perform the subsequent step of cutting easily and without the need for complex tools, as well as to obtain a wearable ornament.

This thickness is selected in a different way depending on the used metal.

In the case of silver, it will be between 1.5 and 2.0 mm. In the case of gold, it will be between 0.4 and 0.6 mm, and preferably between 0.45 and 0.50 mm. In the case of platinum, it will be between 0.4 and 0.6 mm, and preferably between 0.45 and 0.55 mm. The step of tracing the profile 3 can be carried out either directly on the sheet, plate or foil 1 (for example by a felt-tip pen or a stylus), or on a separate support (such as a sheet of flimsy paper) that can be applied and superimposed to said sheet, plate or foil 1.

The step of cutting the sheet, plate or foil 1 for obtaining the ornament 5 can be carried out according to any known technique available to the person skilled in the art. More particularly, it can be manually performed by using a hacksaw (which is known in goldsmithing but is traditionally used for purposes other than jewelry making), but the use of more advanced techniques, such as laser cutting and the like, is not excluded.

From the above description it is evident that the method according to the invention achieves the objects set forth above as it allows to obtain ornaments of pure precious metals having any desired shape, substantially without any limitation.

More particularly, it will be evident that the method according to the invention provides for the considerable advantage of manufacturing "tailor-made" ornaments.

The user will be able to see the manufacturing of an ornament made according to his/her own original design, immediately and before his/her eyes, without any waiting time.

As mentioned above, the method according to the invention may provide for subsequent finishing steps.

More particularly, it is possible to provide a step of finishing and smoothing the edges of the ornament 5.

This step of finishing and smoothing of the edges allows to simultaneously achieve three different purposes: further improving the aesthetic appearance of the ornament by improving the appearance of the structure of said edges; eliminating cutting surfaces that could cause scratches or other unpleasant and annoying feelings to the user; eliminating sharp surfaces that could get caught and damage clothes or other ornaments.

Said step of finishing and smoothing can be carried out in two stages: a first stage of rougher processing in which a file or similar tool is employed, and a second stage of finer processing in which sandpaper with an appropriate grit is used.

It is also possible—and preferable—to provide a step of glazing.

This glazing step helps preventing aesthetic degradation due to the formation of scratches and abrasions that could affect a polished and unglazed surface and it is particularly advantageous in the case of ornaments made of pure precious metals as they are particularly prone to formation of scratches, lines and similar signs due to their ductility and malleability.

Said glazing step can be carried out by using spatulas and/or sponges having suitable roughness.

Moreover, after having obtained the ornament 5 with the desired shape, it will be possible to subject said ornament to surface treatments and/or to various types of setting, such as setting of precious stones, semi-precious stones or pearls and/or to various types of engraving (including engraving photographs) and/or to applying enamel.

The degrees of freedom in obtaining ornaments by the method according to the invention are thus further increased.

According to the usual practice in this field, the obtained ornaments may also be subjected to punching, namely for putting on the ornament the seal of the craftsman manufacturing the ornament and the fineness of the used precious metal.

Unlike the case of jewels made of alloys, in the case of ornaments according to the invention such a punching step may cause the formation of unsightly marks due to the higher ductility and malleability of pure precious metals. Accordingly, the method according to the invention provides, after the punching step, a subsequent step of further glazing in order to remove those unsightly marks.

In FIGS. 2*a*-2*d* some possible applications of ornaments obtained by the method according to the invention are schematically shown.

Figure 2A:
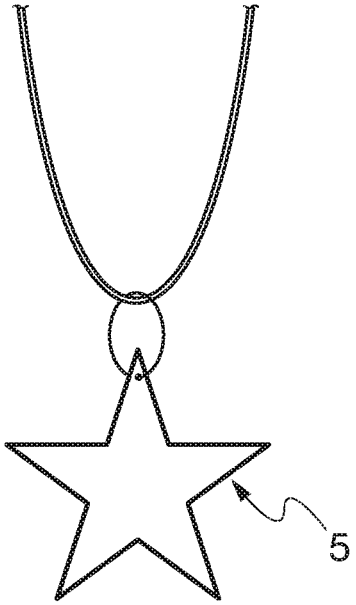
FIGS. 2*a*-2*d* schematically show some possible applications of the ornament manufactured by the method according to the invention.
Figure 2B:
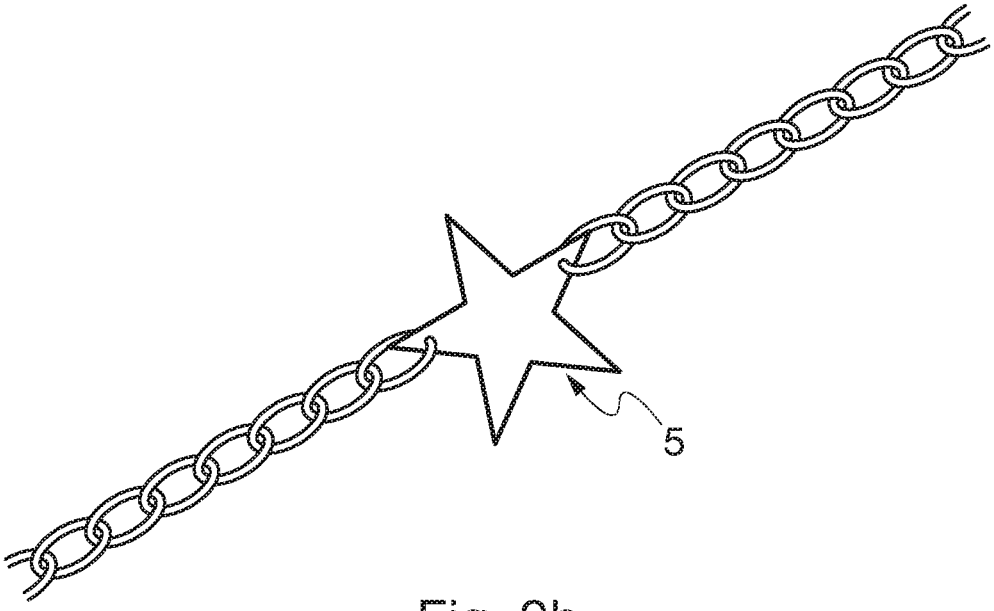
Figure 2C:
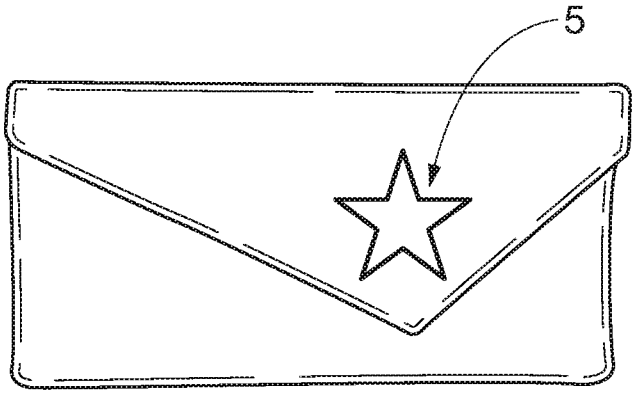
Figure 2D:
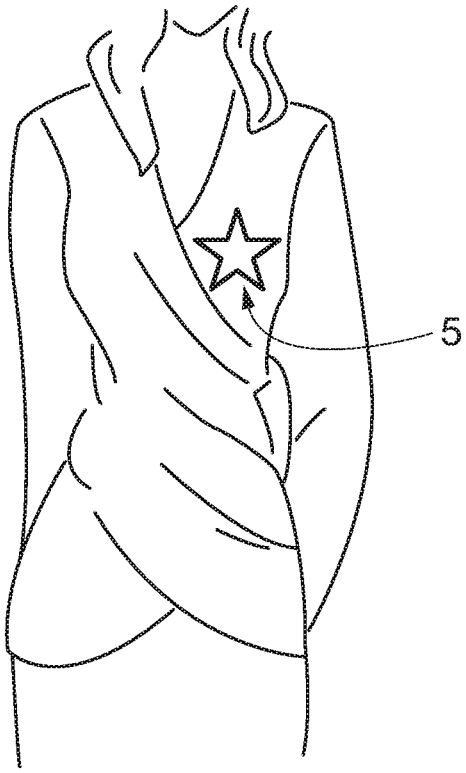

More particularly:

- it is possible to envisage using such ornament alone, for example as a pendant (FIG. 2*a*);
- it is possible to envisage using such ornament as a complement of a jewel, for example, a bracelet (FIG. 2*b*);
- it is possible to envisage using such ornament as an application for a bag or a similar leather product (FIG. 2*c*);
- it is possible to envisage using such ornament as an application for a dress or other clothing (FIG. 2*d*).

It is evident that these examples of application, and in general, the description provided by way of explanation have not to be taken in any way as limiting and many modifications and variations are within the reach of the person skilled in the art, without departing from the scope of protection defined by the appended claims.

For example, it is evident that, in addition to the non-limiting examples of FIGS. 2*a*-2*d*, the ornaments obtained by the method according to the invention may be incorporated into any items or accessories (glasses, key-rings, and so on).

The invention claimed is:

1. A method for manufacturing an ornament made of precious metal, comprising:

- providing a sheet or plate or foil of pure precious metal with a fineness equal to or greater than 999 parts per thousand;
- tracing the profile of a desired shape;
- cutting the sheet or plate or foil according to the profile by using a hacksaw in order to obtain the ornament having the desired shape;
- wherein the pure precious metal is pure gold and wherein said sheet or plate or foil has a thickness between 0.40 and 0.60 mm;
- wherein the sheet, plate or foil is obtained by:
  - melting the precious metal in a crucible and successively casting in a mold;
  - rolling the metal thus obtained in a rolling machine;
  - eliminating irregularities present in the sheet, plate or foil, by means of a new passage through the rolling machine, but in a reverse direction and by processing with cross-strokes;

and wherein the method further comprises, after cutting the sheet or plate or foil according to the profile, glazing the ornament.

2. The method according to claim 1, wherein the profile is traced on a separate support that can be applied and superimposed to the sheet or plate or foil.

3. The method according to claim 1, further comprising, after cutting the sheet or plate or foil according to the profile, finishing and smoothing the edges of the ornament.

4. The method according to claim 1, further comprising, after cutting the sheet or plate or foil according to the profile, carrying out surface treatments of the ornament.

5. The method according to claim 1, further comprising, after cutting the sheet or plate or foil according to the profile, applying the ornament on a carrier.

6. The method according to claim 1, wherein the sheet or plate or foil has a thickness between 0.45 mm and 0.50 mm.

7. The method according to claim 1, further comprising, after cutting the sheet or plate or foil according to the profile, setting precious stones, semi-precious stones or pearls in the ornament.

8. The method according to claim 1, further comprising, after cutting the sheet or plate or foil according to the profile, engraving the ornament.

9. The method according to claim 1, further comprising, after cutting the sheet or plate or foil according to the profile, engraving photographs on the ornament.

10. The method according to claim 1, further comprising, after cutting the sheet or plate or foil according to the profile, applying enamel on the ornament.

* * * * *